US006631631B2

(12) United States Patent
Müller et al.

(10) Patent No.: US 6,631,631 B2
(45) Date of Patent: Oct. 14, 2003

(54) TWO-ROLL ROUNDING MACHINE AND METHOD FOR ROUNDING SHEET-METAL BLANKS

(75) Inventors: Eugen Müller, Dietikon (CH); Jakob Müller, Enges (CH)

(73) Assignee: Elpatronic AG, Bergdietikon (CH)

( * ) Notice: Subject to any disclaimer, the term of this patent is extended or adjusted under 35 U.S.C. 154(b) by 17 days.

(21) Appl. No.: 09/972,476

(22) Filed: Oct. 5, 2001

(65) Prior Publication Data

US 2002/0043088 A1 Apr. 18, 2002

(51) Int. Cl.[7] ..... B21D 5/14
(52) U.S. Cl. ..... 72/169; 72/166
(58) Field of Search ..... 72/166, 169, 170, 72/173, 146, 148

(56) References Cited

U.S. PATENT DOCUMENTS 1,930,562 A * 10/1933 Kreuger ..... 72/106
2,719,562 A * 10/1955 Beegle ..... 72/134
3,899,911 A * 8/1975 Ogier et al. ..... 72/169
4,736,605 A * 4/1988 Klockner et al. ..... 72/8.8
4,964,587 A * 10/1990 Oki et al. ..... 242/532
5,361,618 A * 11/1994 Stefanelli ..... 72/174

FOREIGN PATENT DOCUMENTS

| | | | | |
|---|---|---|---|---|
| JP | 41-13974 | * 8/1966 | ..... | 72/166 |
| RU | 880556 | * 11/1981 | ..... | 72/169 |
| SE | 61988 | * 11/1926 | ..... | 72/398 |

* cited by examiner

*Primary Examiner*—Daniel C. Crane
(74) *Attorney, Agent, or Firm*—McCormick, Paulding & Huber LLP

(57) ABSTRACT

On a two-roll rounding machine, in addition to a compressively elastic guide roll and a compressively rigid rounding roll, one or more compressively elastic rolls are provided which have both a rounding function and a supporting function for the rounding roll. These additional rolls may also be supported by a back-up roll. The result is a rounding machine that has very good rounding characteristics even at small rounding diameters.

10 Claims, 3 Drawing Sheets

TWO-ROLL ROUNDING MACHINE AND METHOD FOR ROUNDING SHEET-METAL BLANKS

This application is entitled to the benefit of and incorporates by reference essential subject matter disclosed in Swiss Patent Application No. 2000 2009/00 having a filing date of Oct. 12, 2000.

BACKGROUND OF THE INVENTION

1. Technical Field

This invention relates to an apparatus and method for forming sheet products in general and to apparatus and method for forming sheet products that utilize rolls in particular.

2. Background Information

Two-roll rounding machines are known. In these, the sheet-metal blank to be rounded is passed between a rounding roll made of metal and a guide roll with a compressively elastic coating of a plastic material (e.g. Neoprene) with the rolls pressed against each other so that an indented region is formed in the compressively elastic coating, in which deformation of the blank around the rounding roll takes place.

Generally speaking, rounding machines should achieve the best possible rounding of the leading and trailing edge regions of the sheet-metal blank, even in small-diameter rounded sheet-metal tubes with diameters of e.g. 30–80 mm. For this reason, on three-roll rounding machines (e.g., European Patent Applications EP-A 0368686 or EP-A 0096643) the distance between the two working rolls is kept as small as possible. On two-roll rounding machines, flat zone formation is in any event slight owing to the effect of the plastic coating of the guide roll, yet an improvement is desirable here also, particularly when the rounding roll diameter is very small, in the said range of 30 to 80 mm.

Therefore one fundamental problem of the invention is to provide an improved two-roll rounding machine.

DISCLOSURE OF THE INVENTION

According to the present invention, a two-roll rounding machine is provided that includes a first compressively elastic guide roll, a compressively rigid rounding roll, and a second compressively elastic roll. The second compressively elastic roll acts on the compressively rigid rounding roll.

By the provision of an additional roll with a compressively elastic coating (hereinafter called compressively elastic roll for simplicity), further rounding can take place, and this improves the end result. Moreover this additional roll stabilizes the rounding roll by preventing deflection, which is particularly desirable when the diameter of the rounding roll is small.

Preferably, two such additional compressively elastic rolls are provided, yielding, in particular, good rounding and stabilization of the rounding roll against deflection.

Preferably also, one or more back-up rolls are provided which in turn support the compressively elastic rolls, these back-up rolls not normally being rolls with a compressively elastic coating (they may therefore be called compressively rigid rolls).

Preferably also, at least one guide is provided which leads the blank emerging from the first roll pair (guide roll, rounding roll) to the second roll pair (rounding roll, additional roll).

A further fundamental task of the invention is to provide a rounding method which does not possess the said drawbacks.

According further to the present invention, a method for rounding sheet-metal blanks is provided that utilizes a two-roll rounding machine, and wherein the sheet-metal to be rounded is passed between the first compressively elastic guide roll and the compressively rigid rounding roll at least twice. It has been found that particularly good rounding is obtained if the blank makes two passes through the rounding machine according to the invention.

BRIEF DESCRIPTION OF THE DRAWINGS

Embodiments of the invention will now be described in detail by way of example and with reference to the drawings.

DETAILED DESCRIPTION OF THE INVENTION

Figure 1:
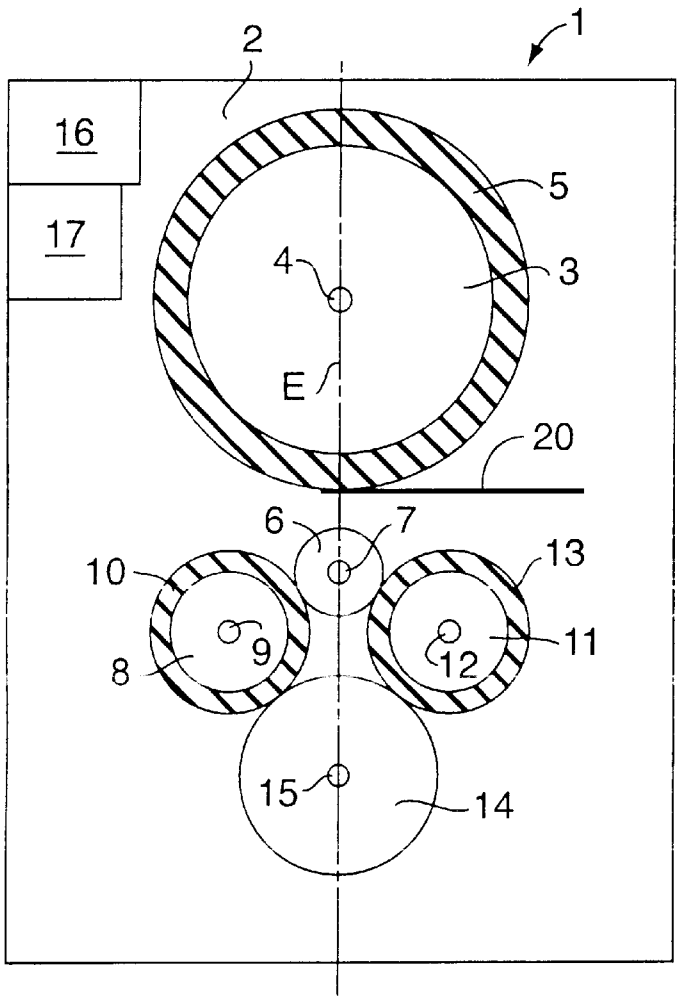
FIG. 1 shows schematically a two-roll rounding machine in a first position.

FIG. 1 shows highly schematically a first embodiment of a two-roll rounding machine 1. This machine has a machine frame, represented simply as a box 2, in which the journals of the machine's rolls and rollers are mounted, their axes in this schematic representation being assumed perpendicular to the plane of the drawing. A drive represented simply as a box 17 for the live rolls, and an electronic control 16 which controls the drive, are also provided in or on the machine frame. In FIG. 1 the guide roll 3 of the rounding machine is shown with its coating 5 which is elastically deformable in compression. This coating is a plastic coating known in the context of such machines, and will not be described in detail here. Because of this coating, the roll 3 will hereinafter be referred to as the compressively elastic guide roll. The roll is mounted in the machine frame 2 rotatably about its axis 4. 6 denotes the rounding roll of the rounding machine; this roll does not carry a compressively elastic coating, and will therefore be referred to as the compressively rigid rounding roll. FIG. 1 shows this roll parted from the guide roll 3 so that the sheet-metal blank 20 to be rounded can be pushed between the rolls.

Figure 2:
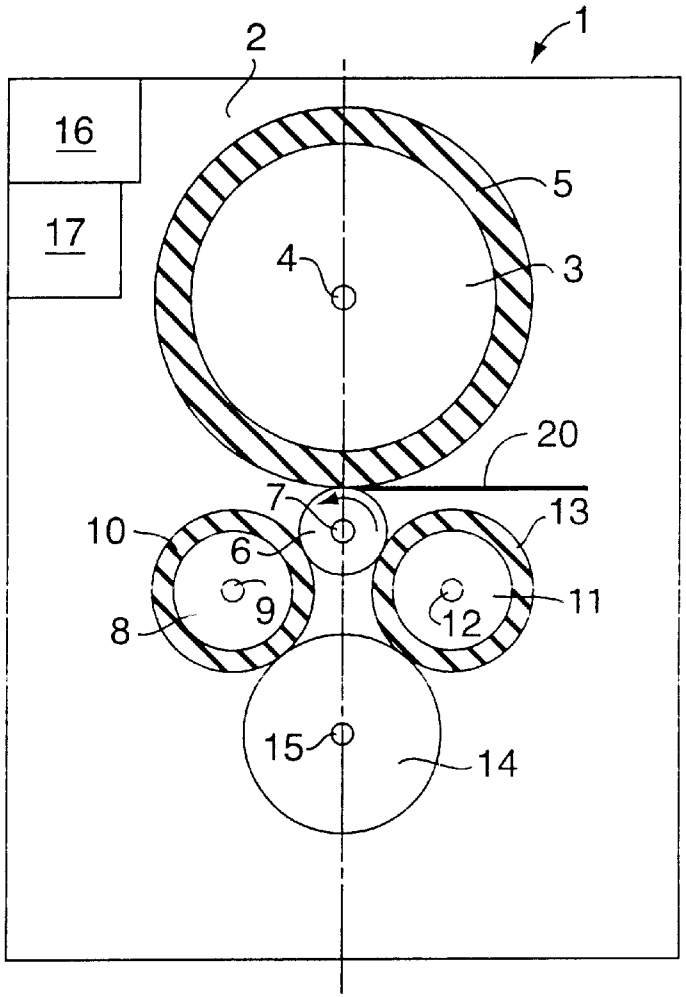
FIG. 2 shows the rounding machine of FIG. 1 in a second position.

FIG. 2, in which the same reference numbers denote the same elements as in FIG. 1, shows the actual rounding position, in which the rounding roll 6 is pressed against the guide roll 3 and makes an indentation in the compressively elastic coating 5 of the guide roll, the effect of which is that the blank is pressed on to the rounding roll. The blank is rounded in the conventional way by means of these two rolls 3 and 6, by driving the rounding roll 6 by means of the drive 17, which turns the rolls as shown by arrows in FIG. 2 and causes the blank 20 to be drawn between the rolls 3 and 6 and rounded around the roll 6.

In the embodiment of the invention shown in FIGS. 1 and 2, two additional compressively elastic rolls, i.e. rolls which likewise have a plastic coating, are provided, which bear on the compressively rigid rounding roll 6. In the illustrated example, these two rolls 8 and 11, with their coatings 10 and 13 and axes 9 and 12, which extend parallel with the axes 4 and 7 of the rolls 3 and 6, are arranged on either side of the rounding roll 6, in the region facing away from the guide roll 3. The rolls 8 and 11 are symmetrically arranged with respect to the plane E passing through the axes 4 and 7. One effect of the compressively elastic rolls 8 and 11 is to produce further rounding of the blank 20 around the compressively rigid rounding roll 6. Another effect of these rolls is to support the rounding roll 6, which is particularly advantageous in the case of rounding rolls 6 of small diameter, particularly in the diameter range of 30–80 mm.

With the configuration shown, the blank 20, which peels away again from the rounding roll 6 after the initial rounding between it and the guide roll 3, can impinge more or less obtusely on the roll 8, or on the coating 10 of the roll 8. This may result in an undesired bowing or buckling of the blank, which, however, is subsequently removed in the re-forming as the blank passes between the rolls 8 and 6 and also between the rolls 11 and 6. Particularly good rounding results if the blank 20 makes two passes through the said rolls, that is to say, after the first rounding operation by means of the roll pairs 3 and 6, 8 and 6, and 11 and 6, it is passed one more time through the rolls 3 and 6 followed again by the rolls 8 and 6 and 11 and 6. This reliably eliminates any unrounded, or incorrectly rounded, portions. The control 16 of the machine is suitably configured to effect a double pass of each blank.

In order that the rounded blank 20 can be removed, the rounding roll 6 is parted again from the guide roll 3 as shown in FIG. 1, and the rolls 8 and 11 are also parted from the rounding roll 6, in order that the rounded blank can be withdrawn from the rounding machine in a direction perpendicular to the plane of the drawing. The rolls 8 and 11 may be moved with a translational motion downwards in the drawing, or each of their axes 9 and 12 may be swung outwards about a pivotal axis so that the rolls 8 and 11 release the rounding roll 6. The rolls 8 and 11 are then brought back into the position shown in FIGS. 1 and 2 for the next rounding operation.

Instead of being continuous, the rolls 8 and 11 may be designed and constructed as a series of coaxial rolls spaced apart from one another.

Preferably, a back-up roll 14 is also provided to support the compressively elastic rolls 8 and 11 in their turn. In the example shown the back-up roll 14 is mounted rotatably about an axis 15 and is a compressively rigid back-up roll; i.e. it does not have an elastic coating.

Figure 3:
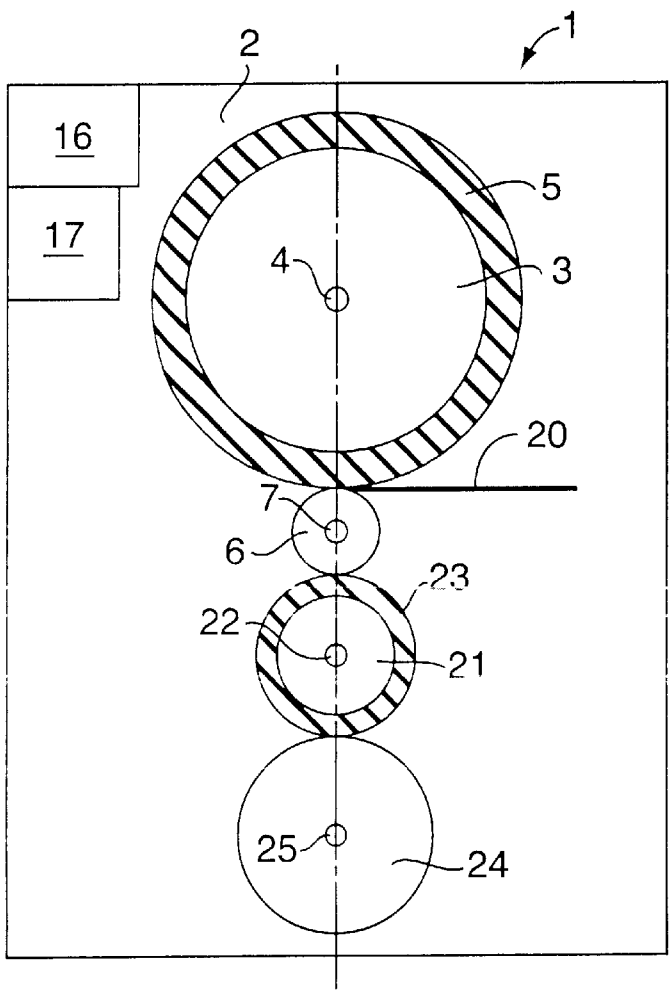
FIG. 3 shows a further embodiment of a rounding machine according to the invention.

FIG. 3 shows a further embodiment, with the same reference numbers as used hitherto designating the same elements. Here also, rounding of the blank 20 takes place between the compressively elastic guide roll 3 and the compressively rigid rounding roll 6. Underneath the latter, only a single compressively elastic roll 21, with coating 23, is provided in this embodiment, and is arranged rotatably about an axis 22. Again, the roll may be made up of a plurality of individual rollers. Underneath this roll, a compressively rigid back-up roll 24 is, again, mounted on an axis 25, to provide support for the roll 21. The roll 21 serves to round the blank and support the rounding roll 6 in the manner which has already been described.

Figure 4:
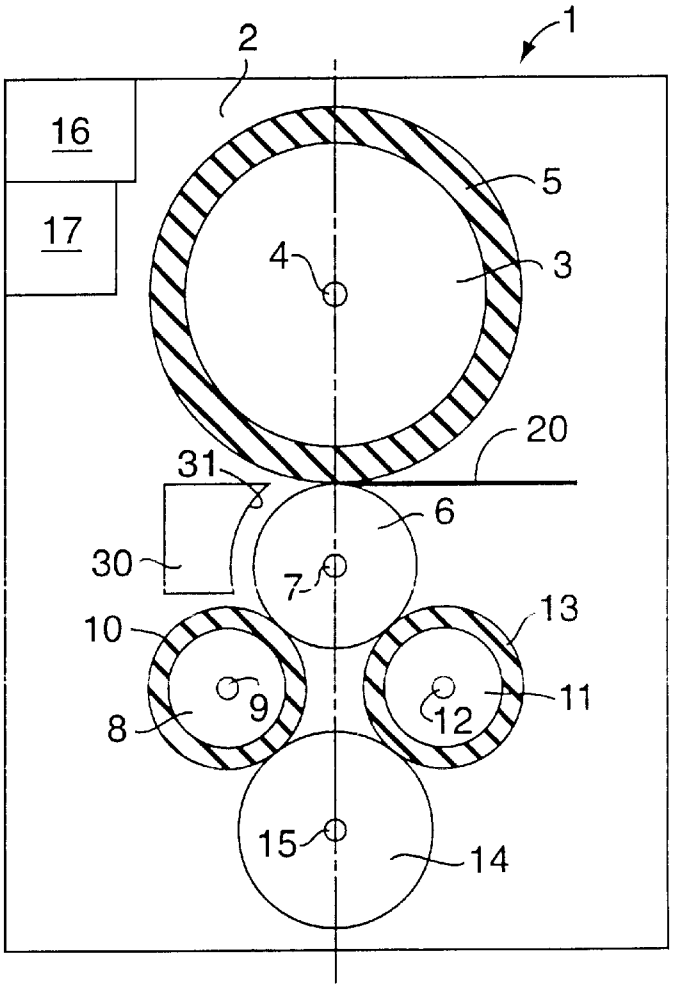
FIG. 4 shows an embodiment with a guide.

FIG. 4 shows a further embodiment, again with the same reference numbers used to denote the same elements. Here again an embodiment with two compressively elastic rolls 8 and 11 is shown, to which is added a guide 30 which by its guide face 31 receives and guides the rounded blank emerging between the rolls 3 and 6, so that the rounded blank is introduced between the rolls 8 and 6 in a suitable position. The guide 30 reliably prevents upsetting or buckling of the blank 20 upon initial contact with the roll 8. In this case a single pass of the blank through the roll pairs 3 and 6, 8 and 6, and 11 and 6 is usually sufficient.

Figure 5:
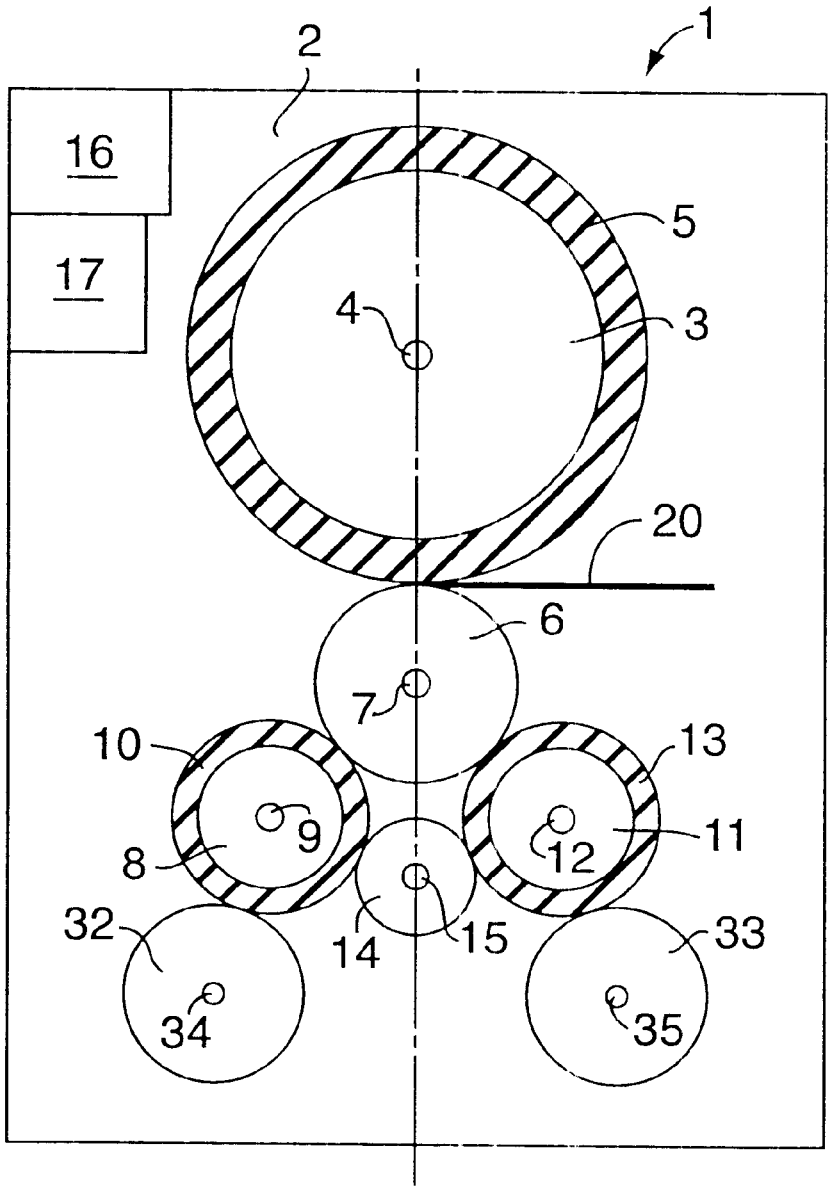
FIG. 5 shows a further embodiment of the present invention rounding machine.

FIG. 5 shows a further embodiment, with the same reference numbers again designating the same elements. This embodiment differs from that of FIGS. 1 and 2 (and 4) in that, besides the back-up roll 14 common to the rolls 8 and 11, individual back-up rolls 32 and 33 are additionally provided for the rolls 8 and 11 respectively. The rolls 32 and 33 are rotatable about axes 34 and 35 respectively. Of course, the cycle of insertion and offloading that has been described, and the corresponding drive and control, and the building-up of individual rolls from separate coaxial rollers as already described, apply to this example also.

What is claimed is:

1. An apparatus for rounding sheet-metal blanks, comprising:

a first compressively elastic roll;

a second compressively elastic roll;

a compressively rigid rounding roll; and a compressively rigid back-up roll;

wherein the first compressively elastic roll and the second compressively elastic roll each act on the compressively rigid roll to cause sheet-metal blanks to be rounded around the compressively rigid roll, and the compressively rigid back-up roll acts on the second compressively elastic roll.

2. The apparatus of claim 1, further comprising a third compressively elastic roll, wherein the third compressively elastic roll acts on the compressively rigid rounding roll to cause sheet-metal blanks to be rounded around the compressively rigid rounding roll, and the compressively rigid back-up roll acts on the second and third compressively elastic rolls.

3. The apparatus of claim 2, wherein the first compressively elastic roll and the compressively rigid rounding roll each have an axis, and a plane passes through the axes of the first compressively elastic roll and the compressively rigid rounding roll; and wherein the second compressively elastic roll is disposed on one side of the plane and the third compressively elastic roll is disposed on the side of the plane opposite the second compressively elastic roll.

4. The apparatus of claim 3, further comprising a first compressively rigid back-up roll that acts on the second compressively elastic roll and a second compressively rigid back-up roll that acts on the third compressively elastic roll.

5. The apparatus of claim 4, further comprising a guide disposed adjacent the compressively rigid rounding roll, wherein the guide is configured so as to lead the sheet-metal blank between the compressively rigid rounding roll and the second compressively elastic roll.

6. The apparatus of claim 3, further comprising:

a drive for driving the compressively rigid rounding roll; and a control unit for controlling the drive;

wherein the control is selectively operable to cause a sheet-metal blank to execute at least two passes, as a single wall sheet-metal blank for substantially an entire length of the sheet-metal blank, between the first compressively elastic roll and the compressively rigid rounding roll, between the second compressively elastic roll and the compressively rigid rounding roll, and between the third compressively elastic roll and the compressively rigid rounding roll.

7. The apparatus of claim 1, wherein the compressively rigid rounding roll has a diameter of between 30 and 80 millimeters.

8. A method for rounding a sheet-metal blank into a tubular body, comprising the steps of:

providing an apparatus for rounding sheet-metal blanks that includes a first compressively elastic roll, a second compressively elastic roll, a compressively rigid rounding roll, and a compressively rigid back-up roll;

selectively actuating one or both of the first compressively elastic roll and the compressively rigid rounding roll into contact with the other of the first compressively elastic roll and the compressively rigid rounding roll;

selectively actuating one or both of the second compressively elastic roll and the compressively rigid rounding roll into contact with the other of the second compressively elastic roll and the compressively rigid rounding roll;

selectively actuating one or both of the compressively rigid back-up roll or the second compressively elastic roll into contact with the other of the compressively rigid back-up roll or the second compressively elastic roll; and passing the sheet-metal blank two or more times between the first compressively elastic roll and the compressively rigid rounding roll, and between the second compressively elastic roll and the compressively rigid rounding roll to form a single wall tubular body.

9. The method of claim 8, further comprising the steps of:

providing a third compressively elastic roll for the apparatus for rounding sheet-metal blanks;

selectively actuating one or both of the third compressively elastic roll and the compressively rigid rounding roll into contact with the other of the third compressively elastic roll or the compressively rigid rounding roll;

selectively actuating the compressively rigid back-up roll into contact with both the second compressively elastic roll and the third compressively elastic roll, or actuating both the second compressively elastic roll and the third compressively elastic roll into contact with the compressively rigid back-up roll;

passing the sheet-metal blank two or more times between the third compressively elastic roll and the compressively rigid rounding roll to form a single wall tubular body.

10. The method of claim of claim 8, further comprising the steps of;

providing a third compressively elastic roll for the apparatus for rounding sheet-metal blanks;

providing a second compressively rigid back-up roll;

selectively actuating one or both of the third compressively elastic roll and the first compressively rigid back-up roll into contact with the other of the third compressively elastic roll or the first compressively rigid back-up roll; and selectively actuating one or both of the third compressively elastic roll and the second compressively rigid back-up roll into contact with the other of the third compressively elastic roll or the second compressively rigid back-up roll;

passing the sheet-metal blank two or more times between the third compressively elastic roll and the compressively rigid rounding roll to form a single wall tubular body.

* * * * *